US005788525A

United States Patent [19]

Newman et al.

[11] Patent Number: 5,788,525

[45] Date of Patent: Aug. 4, 1998

[54] ANTI-THEFT LAMP ADAPTER

[75] Inventors: Walter Newman, Bayside; David B. Balaban, Hauppauge, both of N.Y.

[73] Assignee: Leviton Manufacturing Co., Inc., Little Neck, N.Y.

[21] Appl. No.: 686,789

[22] Filed: Jul. 26, 1996

[51] Int. Cl.[6] ..... H01R 31/06

[52] U.S. Cl. ..... 439/307; 439/236

[58] Field of Search ..... 439/307, 306, 439/310, 236, 641, 642, 645

[56] References Cited

U.S. PATENT DOCUMENTS

| | | | |
|---|---|---|---|
| 954,823 | 4/1910 | Sargent | 439/307 |
| 1,506,183 | 8/1924 | Kellner | 439/307 |
| 1,506,184 | 8/1924 | Kellner | 439/307 |
| 4,750,892 | 6/1988 | Santopietro | 439/307 |

*Primary Examiner*—Hien Vu
*Attorney, Agent, or Firm*—Paul J. Sutton

[57] ABSTRACT

An adapter for lamps and other electrical devices to be installed in standard lampsockets which prevents unauthorized removal of such lamps or other electrical devices. A screwshell means is placed upon a body member such that relative rotation between them is possible. A tool or key placed in aligned slots or keyways prevents relative rotation so that the adapter can be installed or removed from a lampsocket. The tool or key is then removed permitting relative rotation again, whereby the lamp or other electrical device cannot be removed from the lampsocket. Use of the tool or key fixes the two components with respect to one another and the adapter can be removed.

7 Claims, 5 Drawing Sheets

ANTI-THEFT LAMP ADAPTER

BACKGROUND OF THE INVENTION

1. Field of the Invention

The invention is directed to the field of theft proof lamps and more particularly to adapters which can be used with expensive lamps to prevent their unauthorized removal from lampsockets.

2. Description of the Invention

The prior art known of embodies various types of enclosures or cages which are held in place by a lock in the device itself or a lock applied to the device when closed.

These enclosures often interfere with the changing of the lamps, may restrict the light coverage of the fixture or project unwanted shadows. The locks are easily broken or picked.

SUMMARY OF THE INVENTION

The instant invention overcomes the difficulties noted above with respect to prior art devices by providing an adapter that interfaces with the lamp or other electrical device and the electrical lampsocket into which it is assembled without having any portion which overlaps any part of the lamp or other electrical device. The lamp or electrical device has an insulating body member to which it is mechanically and electrically joined. Placed about one end of the body member is a hollow, metal screwshell means which has an external thread to match the internal screw thread of a lampsocket to permit the screwshell means to threadably engage the lampsocket thread to advance the screwshell into the lampsocket or permit its withdrawal from such lampsocket.

Adjacent the end of the body member containing the screwshell means thereon is a coupling means which couples the screwshell means to said body member permitting the relative rotation of the screwshell means and body member while providing electrical continuity between one element of the lamp and the screwshell means. A flat, central contact is placed at the end of the body member having the screwshell means thereabout to engage the central contact of the lampsocket into which the adapter is placed. This central contact is electrically connected to the second element of the lamp.

The body member has a slot directed inwardly from its surface, parallel to the central longitudinal axis of the adapter and terminates along a line or longitudinal axis parallel with and spaced apart from said central longitudinal axis. Along the top edge of the screwshell means, remote from said central contact are a series of open slots.

To advance the adapter or withdraw it from a lampsocket, a tool or key having a blade that matches the slots of the body member and screwshell means is employed. The body member or screwshell means is rotated until one of the screwshell open slots is aligned with the slot or key way in the body member. The key blade is placed in the aligned slots locking the screwshell means to the body member so that no relative rotation is possible. The adapter can now be made to threadably engage the lampsocket and advanced fully into the lampsocket. The key is removed. With the removal of the key, the body member is free to turn independent of the screwshell means thereby preventing removal of the adapter and attached lamp or electrical device. To remove the adapter, the key is again placed in aligned slots in the body member and screwshell means and the adapter is removed by rotating the adapter. It is an object of this invention to provide an anti-theft lamp adapter.

It is an object of this invention to provide an anti-theft lamp adapter which does not interfere with the operation of the associated lamp.

It is a further object of this invention to provide an anti-theft lamp adapter which employs a special tool and cannot be operated by ordinary, available tools.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
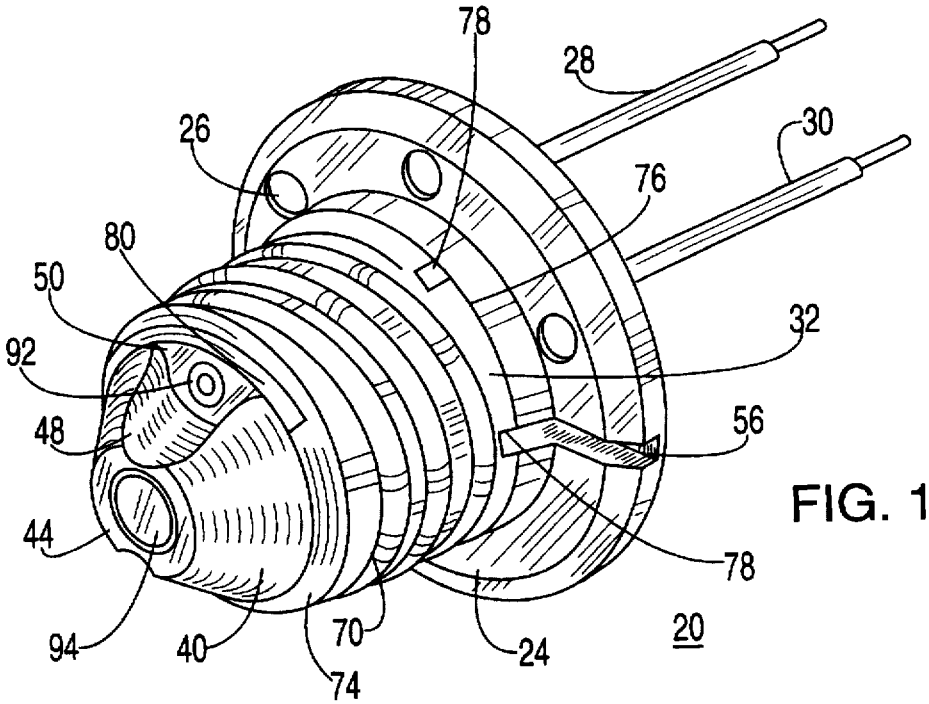
FIG. 1 is a top, right perspective view of an anti-theft lamp adapter constructed in accordance with the concepts of the invention.
Figure 2:
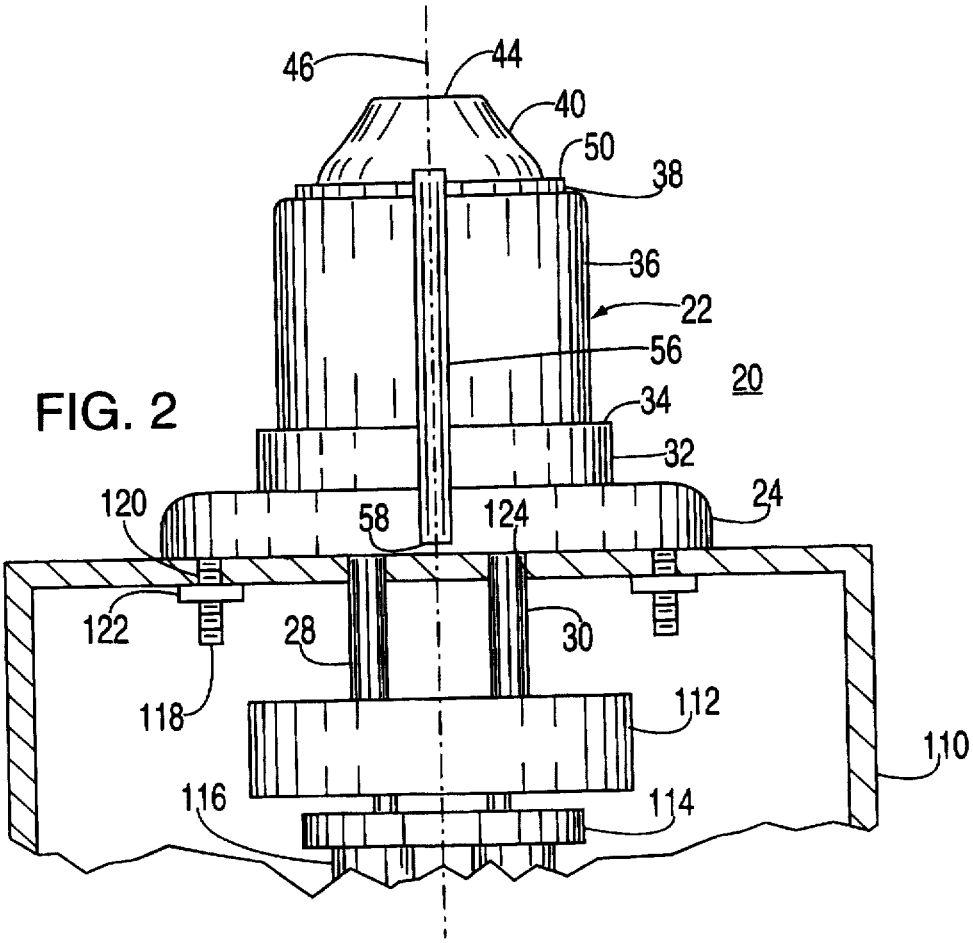
FIG. 2 is side elevational view of the body member of the adapter of FIG. 1 mounted upon a fragmentary portion of an enclosure shown in section.

Turning now to FIGS. 1 to 9, there is shown one form of adapter 20 constructed in accordance with the concepts of the invention. This adapter 20 has a body member 22 fabricated of insulating material, such as rubber, plastic, phenolic or the like. Body member 22 has a first cylindrical portion or flange 24 of a first diameter and thickness. As shown in FIG. 1, there are a number of apertures 26 spaced along flange 24 which can be used to fasten adapter 20 to a housing 110 which contains an electrical device as shown in FIG. 2. The electrical device may be a ballast transformer 112 connected to a dual socket 114 for fluorescent lamps 116. The housing 110 is mounted to flange 24 by means of bolts 118 passed through apertures 26 in flange 24 and apertures 120 in housing 110 and nuts 122 tightened upon such bolts 118. The insulated conductors 28 and 30 pass through an aperture 124 in housing 110 and are connected to the transformer 112 and socket 114. Body member 22 has a second cylindrical portion 32 of lesser diameter than first portion 24 and has a surface 34 which acts as an upper stop for the screwshell member. Portion 32 is about as thick as portion 24. A further cylindrical portion 36 is of smaller diameter than portion 32 and is of much greater thickness than portion 32. A cylindrical step 38 of lesser diameter than portion 36 and of small thickness leads to a truncated conical end 40 of lesser diameter than step 38 and a truncated end surface 44 perpendicular to central longitudinal axis 46.

Figure 3:
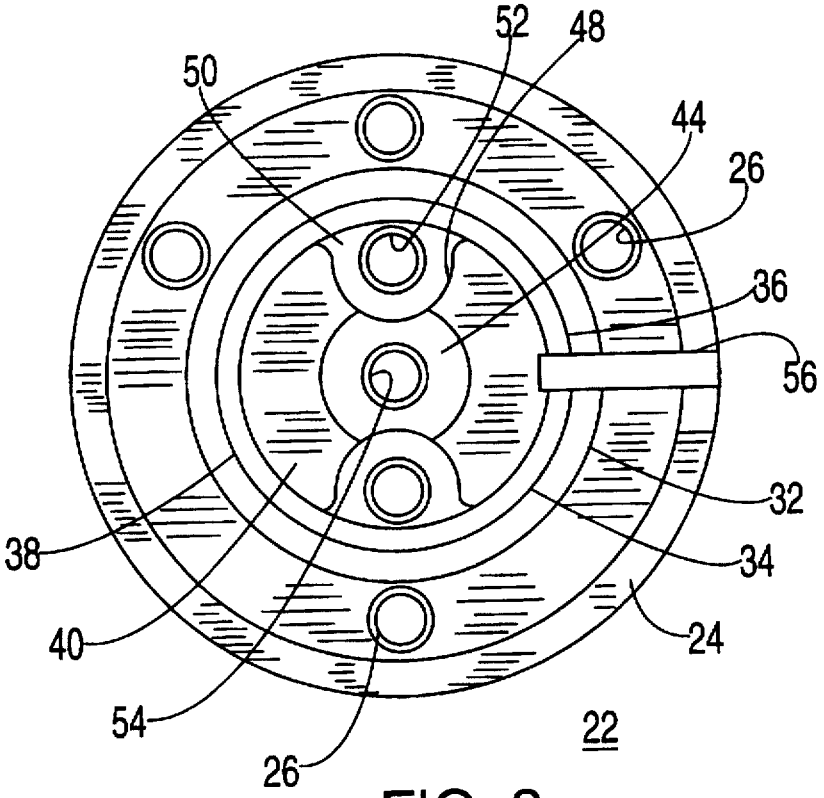
FIG. 3 is a top plan view of the body member of FIG. 2.

As best seen in FIG. 3, there are two depressions 48 in the sides of conical end 40 set at positions 1800 apart which expose a portion of the upper surface 50 of step 38. An aperture 52 is placed in each of the exposed surfaces 50. A further aperture 54 is placed in end surface 44.

The arrangement of the component parts of the adapter 60 for the compact fluorescent tubes (see FIGS. 10 and 11) is generally similar to that described above with respect to FIGS. 1 to 9. The difference is that the relatively thin flange 24 is replaced with a much thicker first cylindrical portion 62. The remaining portions are the same.

As shown in FIG. 2 a slot or keyway 56 extends through the lower portion of first cylindrical portion 24 adjacent second cylindrical portion 32, the second cylindrical portion 32, the third cylindrical portion 36, cylindrical step 38 and into conical end 40. Although it is simpler to manufacture the body member 22 with the slot 56 as described, the slot or key way 56 could be stopped at a point just below the open slots of the screwshell means to be described below. The slot 56 does not extend for the entire thickness of flange 24 resulting in a stop 58 to insure proper positioning of the tool to be described below. Because the cylindrical portions 62 of the adapter 60 are very thick it is only necessary that the slot or keyway 64 extend into cylindrical portions 62 for a short distance to provide stop 66. Again, slot or keyway 64 could be made long enough to extend beyond the slots of the screwshell means to be described.

Figure 9:
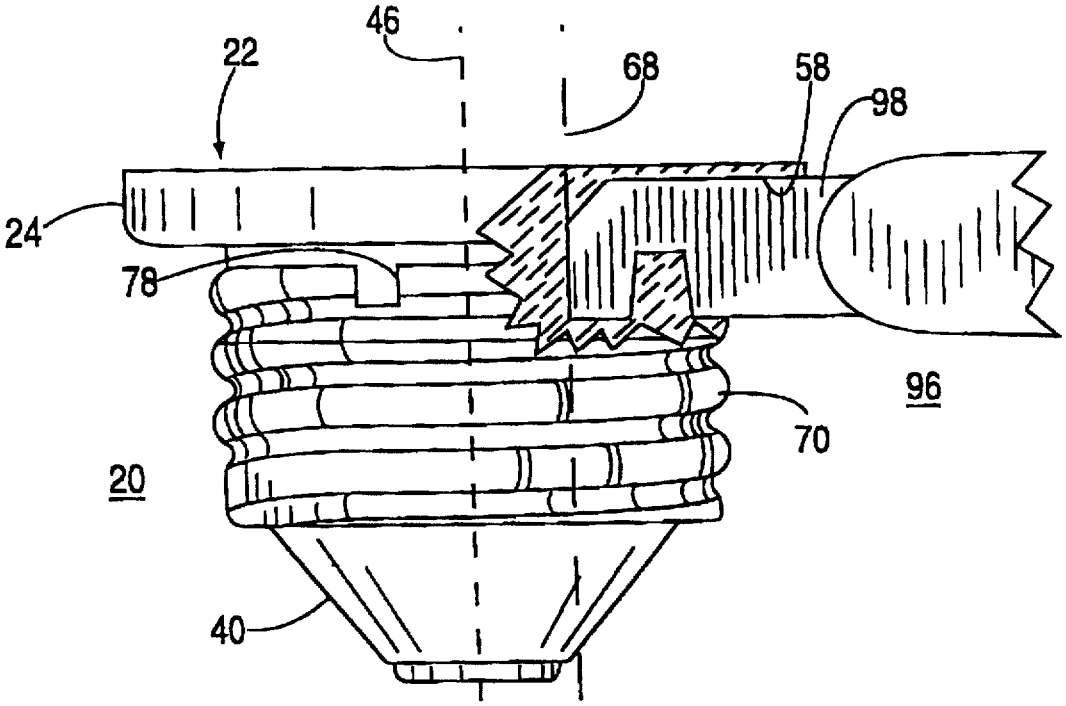
FIG. 9 is a fragmentary side elevational view, partly in section, of the adapter of FIG. 1 with the tool of FIG. 8 in place.

The slot or keyway 56 extends into body member 22 to a depth along the longitudinal axis 68 which is parallel with and offset from longitudinal axis 46 (see FIG. 9).

Figure 4:
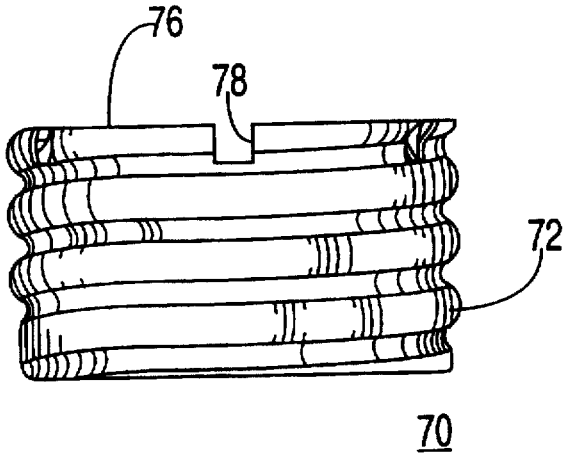
FIG. 4 is a side elevational view of the screwshell means of the adapter of FIG. 1.
Figure 5:
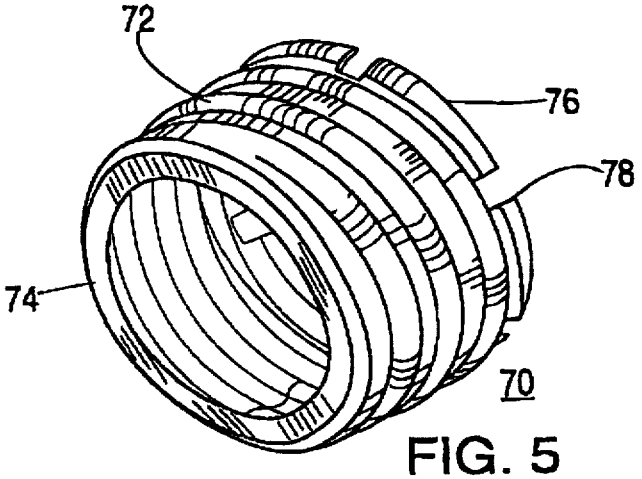
FIG. 5 is a top, right perspective view of the screwshell means of FIG. 4.

The screwshell means 70 is shown in FIGS. 4 and 5. The screwshell means 70 is a hollow cylinder into which is formed a helical thread 72 of the size and pitch of a chosen lamp base, for example, a medium or mogul base lamp. The bottom lip 74 is inturned to ride over surface 50 of step 38 and the top edge 76 has a number of open slots 78 arranged along it. The portion of thread 72 below the closed end of slots 78 engages the surface 34 of cylindrical portion 32 to make relative rotation of screwshell means 70 and body member 22 easier.

Figure 6:
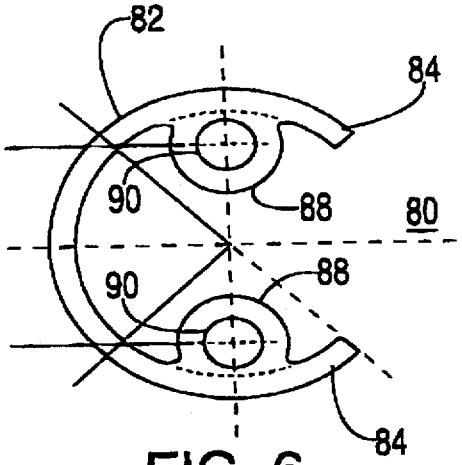
FIG. 6 is a top plan view of the coupling means of the adapter of FIG. 1.
Figure 7:
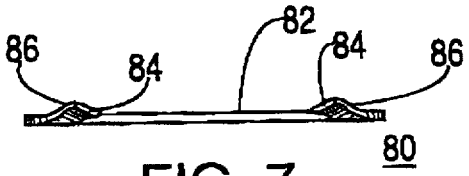
FIG. 7 is a side elevational view of the coupling means of FIG. 6.
Figure 8:
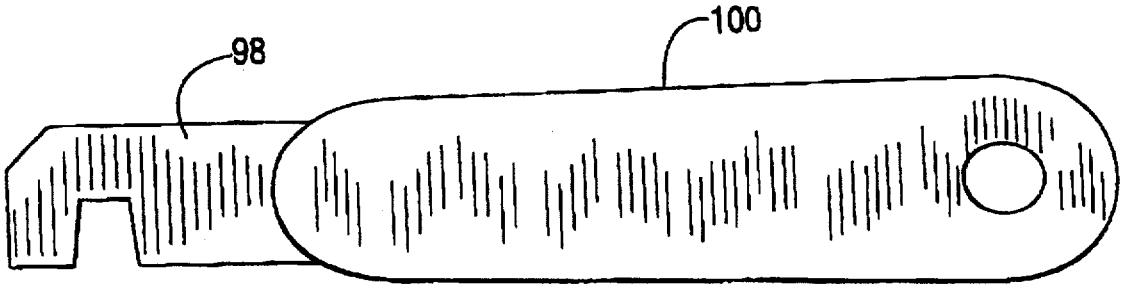
FIG. 8 is a side elevational view of a tool which can be employed with the adapters of the instant invention.

The screwshell means 70 is retained on body member 22 by means of contact washer 80 shown in FIGS. 6 and 7. Contact washer 80 is comprised of a generally C-shaped ring 82 of electrically conductive, spring stock material such as copper or berylium-copper alloys. The ends 84 of ring 82 are bent out of the plane of ring 82 and may be formed with a rounded contact pad 86 as shown in FIG. 7. Extending inwardly from the inner edge or ring 82 are a pair of ears 88, each having an aperture 90 therethrough. After the screwshell means 70 has been placed over step 38 and cylindrical portion 36 of body member 22, the contact washer 80 is placed over the Bottom lip 74 of screwshell means 70 and each of the ears 88 is allowed to extend into its associated depression 48 so that apertures 90 overlie apertures 52. The pads 86 of contact washer 80 are in contact with bottom lip 74 of screwshell means 70. The contact washer 80 is then fixed in place by rivets 92 as shown in FIG. 1. A first insulated conductor 28 is connected to contact ring 80 and by its engagement with screwshell means 70 provides a closed path to one contact or one side of the filament of a lamp or other electrical device. A central contact 94 is positioned on end surface 44 of conical end 40 and fixed thereto and connected via aperture 54 in end surface 44 to the second insulated conductor 30 to provide a closed path to the second contact or the other side of the filament of a lamp or other electrical device. Thus when adapter 20 is screwed into a proper sized lampsocket 102 which is connected to a source of electric current and the control switch (not shown) closed, the lamp or other electrical device connected to insulated conductors 28, 30 will be operated.

Since the screwshell means 70 and body member 22 are free to rotate with respect to one another it would not be possible to threadably advance or withdraw the screwshell means 70 from a lampsocket by rotating the body member 22 by gripping flange 24 or cylindrical portion 62 of adapter 60 and turning them. To do this, it is necessary to assemble, at least temporarily, the body member 22 and the screwshell means 70. This is done with the tool or key 96 shown in FIG. 8. The tool or key has a blade 98 with a thickness less than the width of slot or keyway 56 and long enough to extend to the rear of the slot 56 defined by longitudinal axis 68 and at the same time extend beyond the outer surface of screwshell means 70. The blade 98 can extend to an insulated handle 100 or can end beyond flange 24 so that it can easily be gripped using insulating gloves without the use of a handle.

The screwshell means 70 or body member 22 are rotated until one of the open slots 78 of screwshell means 70 is aligned with slot or keyway 56. Then the tool or key blade 98 is inserted so that it extends all the way back to the line of the longitudinal axis 68 and in engagement with stop 58. The blade 98 is also positioned in an open slot 78. With the elements in this position, as shown in FIG. 9, the screwshell means 70 and the body member 22 cannot rotate independently but rotate as a single unit. The adapter 20 may now be made to threadably engage the screwshell 110 of lamp socket 102. Lamp socket 102 has a generally cylindrical body portion 104 with an internal cavity 108 and an outwardly directed apron 103. Apron 103 has apertures 106 therein to receive fasteners (not shown) to fasten the lamp socket 102 to a gang box, wall or other support (not shown). A threaded screwshell 110 is internally threaded to match the external threads 70 of adapter 20 so that the adapter 20 can be made to threadably engage the screwshell 110 and advance into the cavity 108 of lamp socket 102 until fully seated. A center base contact 116 is positioned in the cavity 108 to contact central contact 94 of adapter 20. Center base contact 116 has a terminal screw 118 which can be connected to one line of an AC source (not shown). The screwshell 110 has an extension 112 which extends to terminal screw 114 to connect it to the second line of an AC source (not shown). The tool or key 96 is removed and the screwshell means 70 and body member 22 are again free and will rotate with respect to one another making removal nearly impossible. To remove the adapter 20 from the lamp socket 102, the tool or key 96 is again inserted into slot or keyway 56 and open slot 78 and the body member 22 is rotated to remove the adapter 20 from the lamp socket lamp 102.

Figure 10:
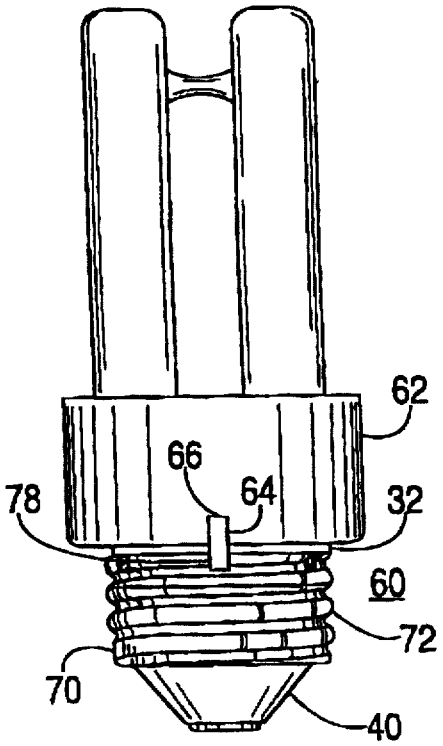
FIG. 10 is a side elevational view of a compact dual tube fluorescent lamp with an adapter according to the instant invention.
Figure 11:
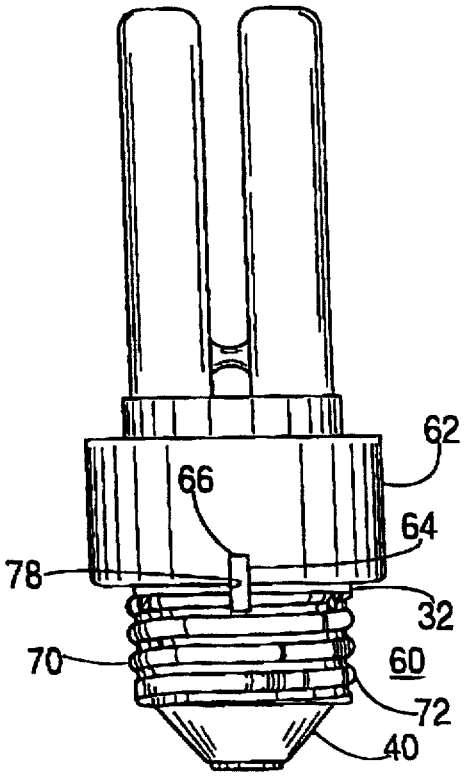
FIG. 11 is a side elevational view of a compact quad-tube fluorescent lamp with an adapter according to the instant invention.
Figure 12:
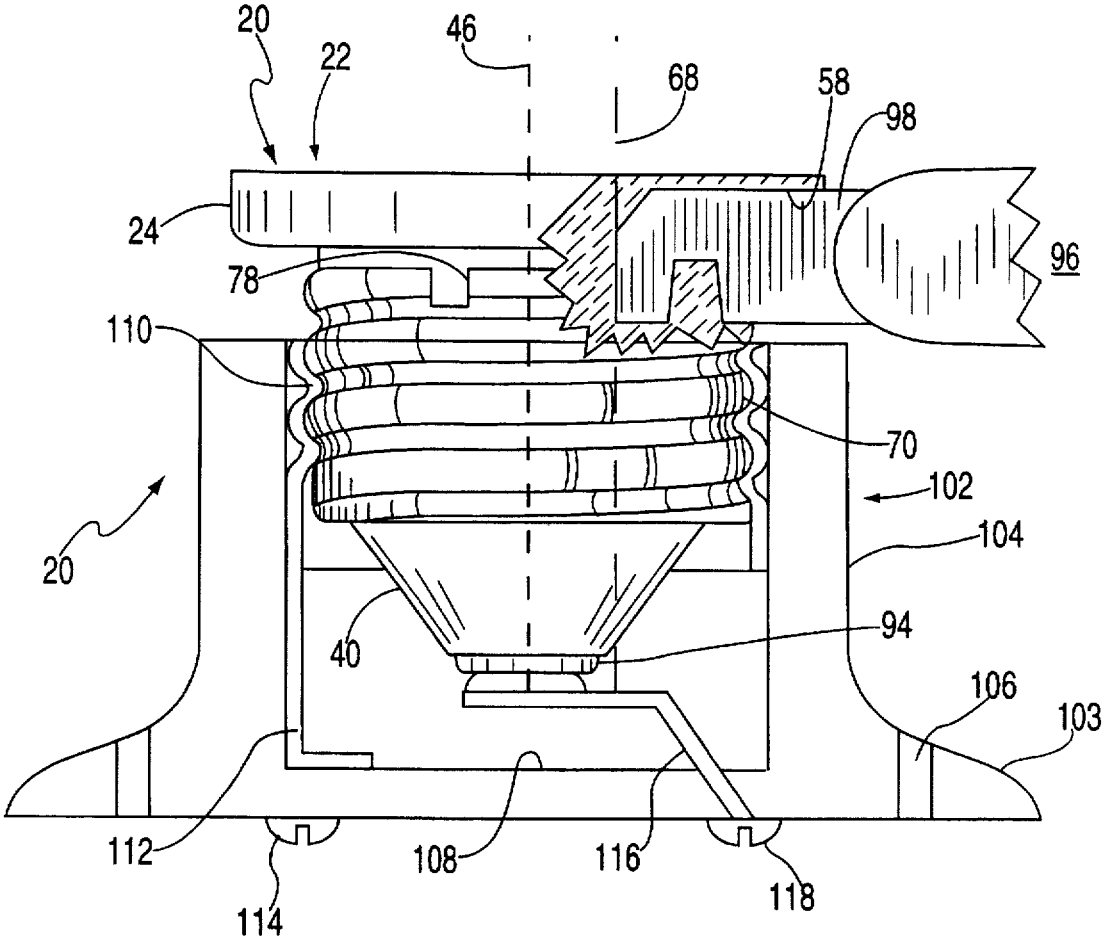
FIG. 12 is fragmentary side elevation view of the adapter of FIG. 1 engaging a lamp socket, shown in section.

The installation and removal of the adapters 60 of FIGS. 10 and 11 will be the same as that described with respect to adapter 20.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. An anti-theft lamp adapter for engaging a hollow socket and a center base contact, said adapter comprising:

a) a body member formed of insulating material, having a first end and a second end;

b) a two terminal lighting device positioned adjacent said body member second end;

c) hollow screwshell means having an external screw thread positioned over the body member and adjacent said first end of said body member, so dimensioned and arranged that it can be made to engage the hollow lamp socket having a hollow screwshell;

d) washer means for coupling said hollow screwshell means to said body member first end, said washer means permitting said hollow screwshell means and said body member to rotate about a first common longitudinal axis of said lamp adapter with respect to one another;

e) selectively positionable tool means having a first position engaging said body member and said hollow screwshell means preventing relative rotation of said hollow screwshell means and said body member to permit said adapter to threadably advance into a lamp socket or withdraw from the lamp socket and a second position not engaging said body member and said hollow screwshell means whereby said body member and said hollow screwshell means remain free permitting relative rotation and preventing an adapter to threadably advance into a lamp socket or withdraw from a lamp socket;

f) said body member comprises:

(i) a first generally cylindrical portion having a first diameter, a first end and a second end parallel with and spaced apart from said first end to describe therebetween a first distance;

(ii) a second cylindrical portion having a second diameter less that said first diameter, a third end adjacent said first end of said first cylindrical portion and a fourth end parallel with and spaced apart from said third end to describe therebetween a second distance;

(iii) a third cylindrical portion having a third diameter less than said second diameter, a fifth end adjacent said fourth end of said second cylindrical portion, and a sixth end parallel with and spaced apart from said fifth end to describe therebetween a third distance;

(iv) a conical portion having at its base a fourth diameter less than said third diameter, said base adjacent said sixth end of said third cylindrical portion;

g) said hollow screwshell means has a plurality of open slots along said first end, each of which can be aligned with a slot in said body member; and h) the insertion of said selectively positionable means in said slot in said body member and said aligned slot in said hollow screwshell means, fixes the position of said hollow screwshell means and said body member such that rotation of said body member rotates said hollow screwshell means so that said adapter can be made to threadably engage or threadably disengage an electrical lamp socket.

2. Anti-theft lamp adapter as defined in claim 1, further comprising:

a) a slot in said first, second and third cylindrical portions, each extending inwardly from its outer cylindrical surface and terminating along a second common longitudinal axis displaced from said fast longitudinal axis;

b) said slot extending for a portion of said first distance adjacent said first end of said fast generally cylindrical portion;

c) said slot extending for said second distance of said second cylindrical portion and said third distance of said third cylindrical portion; and d) through the base of said conical portion.

3. An anti-theft lamp adapter as defined in claim 2, wherein said screwshell means is a cylindrical member having a first end and a second end, said first and second ends separated by a distance generally equal to said third distance of said third cylindrical portion and having an interior diameter in excess of said third diameter of said third cylindrical portion to permit said screwshell means and said body member to freely rotate with respect to one another.

4. An anti-theft lamp adapter as defined in claim 3, wherein:

a) said screwshell means has an inturned annular rib adjacent said second end with an interior surface to engage said sixth end of said third cylindrical portion and an exterior surface; and b) said coupling means is connected to said conical portion of said body member and overlies a portion of the exterior surface of said annular rib to retain said screwshell means upon said body member while permitting relative rotational movement of said screwshell means and said body member and maintain electrical continuity with said screwshell means.

5. An anti-theft lamp adapter as defined in claim 1, further comprising:

a) a slot in said first, second and third cylindrical portions each extending inwardly from its outer cylindrical surface and terminating along a second common longitudinal axis displaced from said first longitudinal axis;

b) said slot extending for a portion of sad first distance adjacent said first end of said first generally cylindrical portion;

c) said slot extending for a second distance of said cylindrical portion; and d) said slot extending for a portion of said third distance adjacent said fifth end.

6. An anti-theft lamp adapter as defined in claim 5, wherein said screwshell means is a cylindrical member having a first end and a second end, said first and second ends separated by a distance generally equal to said third distance of said third cylindrical portion and having an interior diameter in excess of said third diameter of said third cylindrical portion to permit said screwshell means and said body member to freely rotate with respect to one another.

7. An anti-theft lamp adapter as defined in claim 6, wherein:

a) said screwshell means has an inturned annular rib adjacent said second end with an interior surface to engage said sixth end of said third cylindrical portion and an exterior surface; and b) said coupling means is connected to said conical portion of said body member and overlies a portion of the exterior surface of said annular rib to retain said screwshell means upon said body member while permitting relative rotational movement of said screwshell means and said body member and maintain electrical continuity with said screwshell means.

* * * * *